US008045724B2

(12) United States Patent
Sibbald

(10) Patent No.: US 8,045,724 B2
(45) Date of Patent: Oct. 25, 2011

(54) AMBIENT NOISE-REDUCTION SYSTEM

(75) Inventor: Alastair Sibbald, Cookham (GB)

(73) Assignee: Wolfson Microelectronics plc, Edinburgh (GB)

( * ) Notice: Subject to any disclaimer, the term of this patent is extended or adjusted under 35 U.S.C. 154(b) by 520 days.

(21) Appl. No.: 12/269,632

(22) Filed: Nov. 12, 2008

(65) Prior Publication Data

US 2009/0123003 A1 May 14, 2009

(30) Foreign Application Priority Data

Nov. 13, 2007 (GB) ..... 0722240.9

(51) Int. Cl.
*G10K 11/36* (2006.01)

(52) U.S. Cl. ..... 381/71.14; 341/110

(58) Field of Classification Search ..... 381/71.14; 341/110; 708/300, 322; 455/103, 114.1–114.3
See application file for complete search history.

(56) References Cited

U.S. PATENT DOCUMENTS 3,493,901 A * 2/1970 Deboo ..... 333/215
4,229,716 A * 10/1980 Levi ..... 333/28 R
4,985,925 A 1/1991 Langberg et al.
5,353,244 A * 10/1994 Peters et al. ..... 708/3
5,638,454 A 6/1997 Jones et al.

FOREIGN PATENT DOCUMENTS

GB 2 360 165 9/2001
GB 2 436 657 10/2007

* cited by examiner

*Primary Examiner* — Henry Choe
(74) *Attorney, Agent, or Firm* — Dickstein Shapiro LLP

(57) ABSTRACT

A signal processing circuit is intended for use in a noise reduction system, which produces a target filter characteristic that would achieve optimal noise cancellation, the target filter characteristic including a resonant peak at a first frequency. The signal processing circuit comprises an analogue filter, which has an amplitude response that has a peak or trough at a center frequency, and has a phase response that switches polarity at the center frequency and tends to zero with increase or reduction in frequency away from the center frequency. The center frequency in the amplitude response is substantially equal to the first frequency. The analogue filter may be in the form of a series inductive-capacitive-resistive circuit, where the inductive component is in the form of a gyrator.

21 Claims, 13 Drawing Sheets

AMBIENT NOISE-REDUCTION SYSTEM

Figure 1:
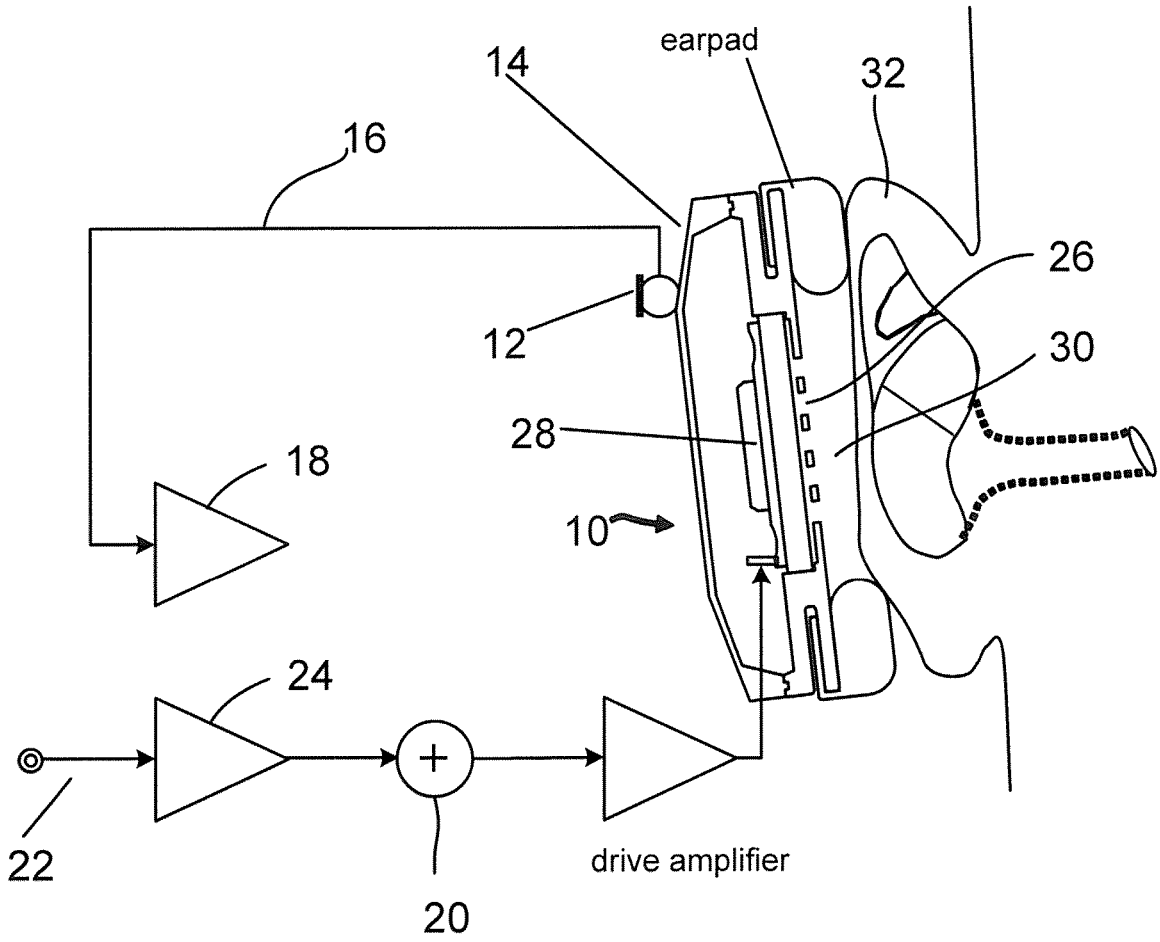

The present invention relates to ambient noise-reduction systems for headphones and earphones, and, in particular, to electrical signal processing required for such systems. It is common to build such signal processing into self-contained "pods" i.e. housings, that are incorporated as part of the connecting leads, but the signal processing can alternatively be integrated directly into host mobile or portable devices, such as personal music players, games consoles, cellular phone handsets, PDAs and the like, in order to share a common power supply and user-control interface, thus saving space and expense. The present invention envisages all such possibilities.

Existing ambient noise-reduction systems are based on either one of two entirely different principles, namely the "feedback" method, and the "feed-forward" method. These two different systems are described in more detail for example in UK patent application No. GB 2436657-A which is commonly owned herewith.

Although the present invention is also applicable to the feedback method, it will be described hereinafter in the context of the feed-forward method in which, as shown in general terms in FIG. 1, ambient acoustic noise occurring around an individual who is listening to an headphone 10 (or alternatively to an earphone, or directly to a mobile or portable device) is detected by a microphone 12 on, or inside, the housing 14 of the earphone 10 and converted into an electrical signal on a line 16. The electrical signal on line 16, which is representative of ambient noise, is electronically inverted by means of a pre-amplifier and inverter 18 and added at 20 to a drive signal input at a terminal 22 from a source such as a music player or a cell phone and buffered by an amplifier 24, so as to create an acoustic cancellation signal which, ideally, is equal in magnitude, but opposite in polarity, to the incoming ambient acoustic noise signal, which (by the time the acoustic cancellation signal has been generated) has reached a position adjacent to the outlet port 26 of the headphone loudspeaker 28 within the cavity 30 between the headphone shell 14 and the listener's outer ear 32. Consequently, destructive wave interference occurs between the incoming acoustic noise and its inverse, the acoustic cancellation signal generated via the headphone 10, such that the ambient acoustic noise level perceived by the listener is reduced.

It will be appreciated that, in order to be effective, such systems fundamentally require the frequency-dependent amplitude and phase characteristics of the generated acoustical cancellation signal to closely match those of the incoming ambient noise signal at the eardrum of the listener. Indeed, extremely close matching is needed for even a modest amount of noise reduction; for example, if 65% noise-cancellation (−9 dB) is to be achieved, then, assuming perfect phase matching, the amplitude of the cancellation signal must be matched to that of the incoming ambient noise signal within ±3 dB. Similarly, even if the amplitudes are perfectly matched, the relative phase of the two acoustical signals must lie within ±20° (0.35 radian).

However, although the external ambient acoustic noise signal is the original, common source of both the noise signal at the ear and its synthesised acoustic cancellation counterpart, these signals are modified considerably and differently by their respective pathways to the eardrum.

In this respect, it will be appreciated that, whilst the ambient acoustic noise signal follows an exclusively acoustic pathway, that or the cancellation signal is primarily electrical, with acoustoelectric and electroacoustic transducers respectively near the beginning and end thereof.

Figure 2:
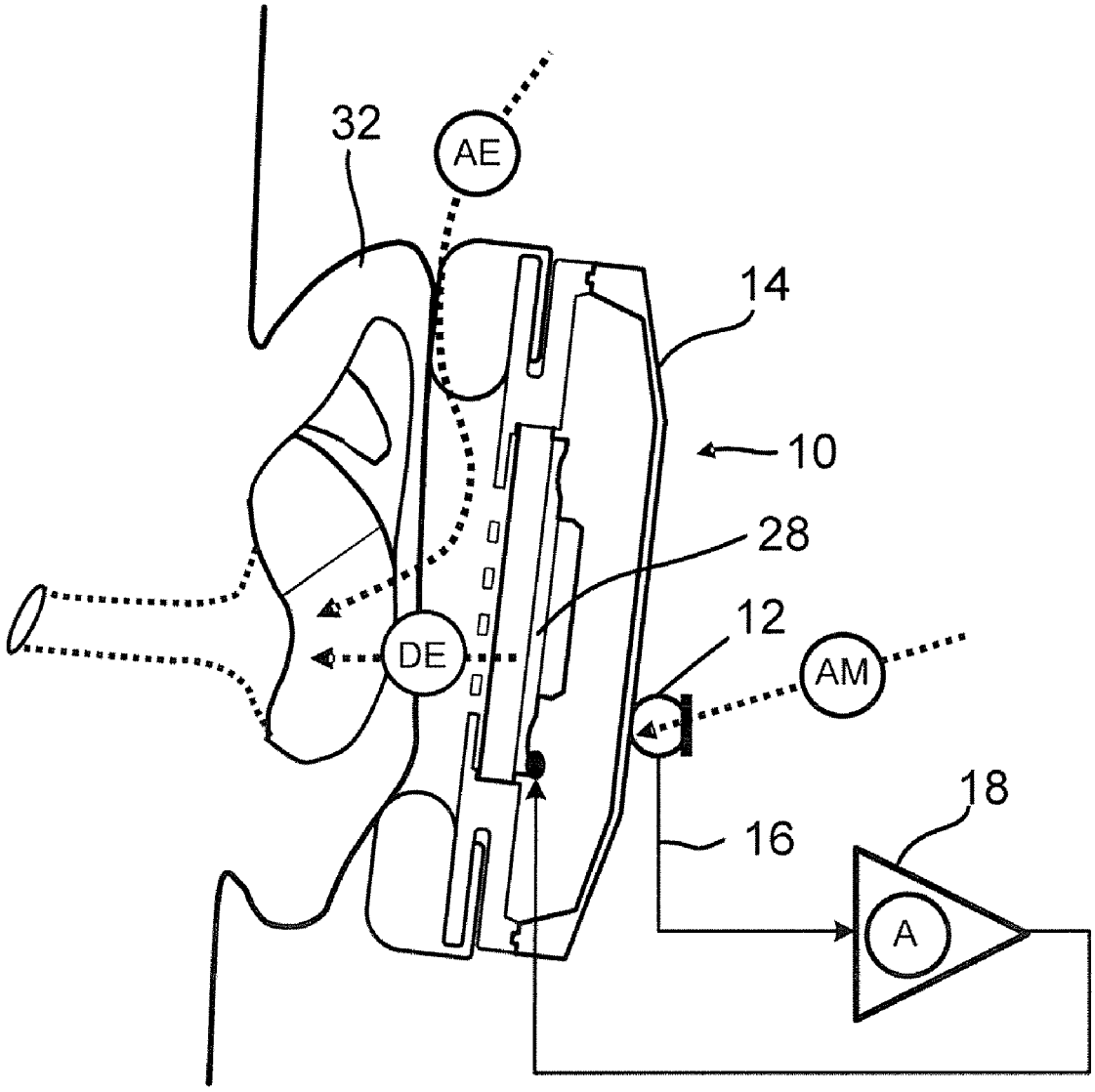
Figure 3:
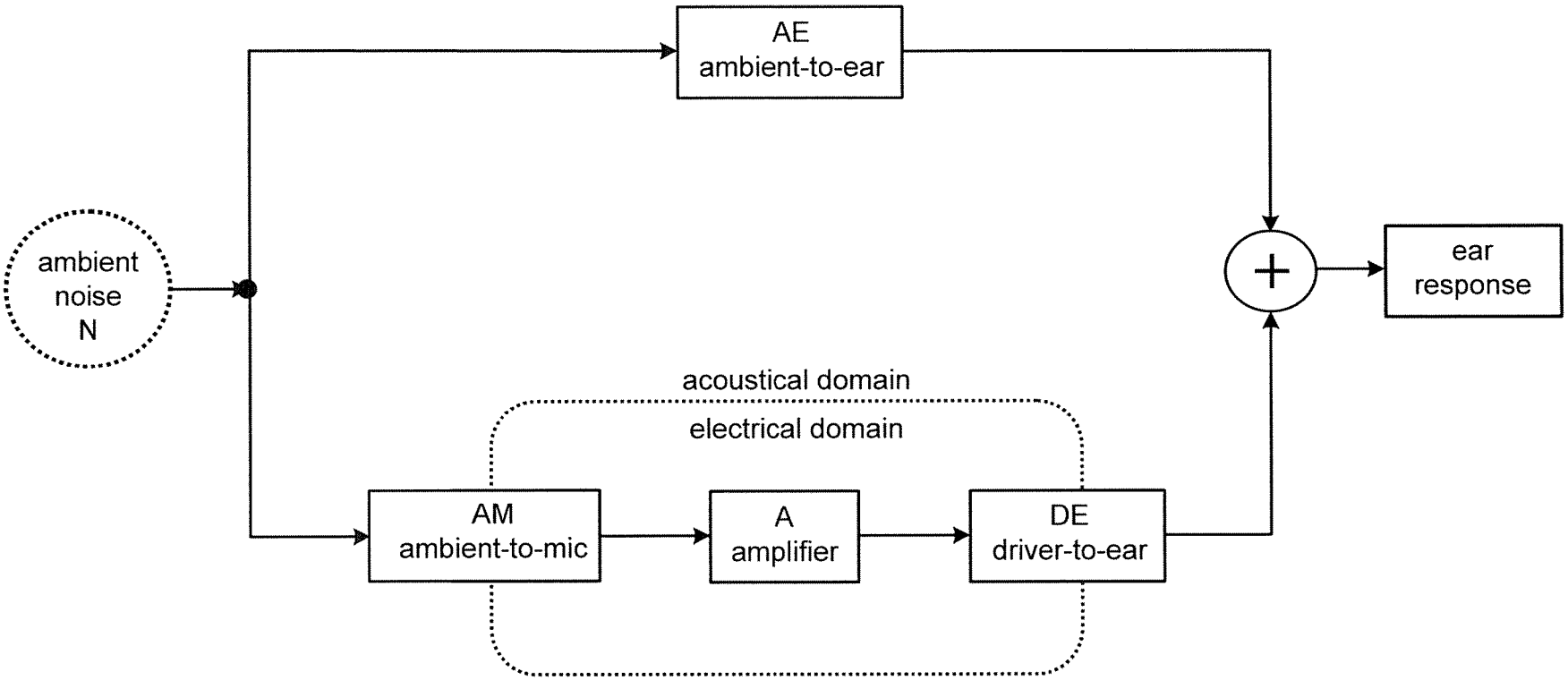

The above-mentioned pathways and some of the significant elements therein are depicted physically in FIG. 2 (wherein elements common to FIG. 1 are identified by the same reference numbers), and in block schematic form in FIG. 3. Each pathway has a respective transfer function comprising both a frequency-dependent amplitude characteristic and an associated frequency-dependent phase characteristic. There are four of these primary transfer functions, as listed below.

1: Ambient-to-Ear (termed hereinafter "AE")

This represents the acoustical leakage pathway by which external ambient acoustic noise signals reach the ear, and includes transmission around and through the earpad and headphone casing, or their equivalent components in other earphone or headphone designs.

2: Ambient-to-Microphone(s) ("AM")

This represents the acoustoelectric response of the external microphone (or microphones) as deployed in their operational mode, which includes local acoustical effects (for example, reflections related to the listener's head).

3: Driver-to-Ear ("DE")

This represents the electro-acoustical couple between the driver unit (typically a small, high-compliance loudspeaker) and the eardrum of the listener. This is strongly influenced by the nature of the acoustical load that it drives, a key feature of which is the acoustical leakage pathway (item 1, above) between the driver-to-ear cavity and the external ambient.

4: Electronic Amplification ("A")

This is the electrical transfer function of the amplifier. Although it is commonplace to provide an amplifier having a "flat" (i.e. relatively constant) amplitude characteristic as a function of frequency, it is usually necessary or convenient in practise to incorporate one or more AC coupling stages, which behave as first-order low-cut (high-pass) filters.

By inspection of FIG. 3, it is possible to define the residual noise spectrum for a simple "invert and add" cancellation system; that is, one which does not use any additional signal processing. The original ambient noise signal is defined here to be N (a function of frequency). The residual noise signal can be computed by vector subtraction of the noise-cancellation signal from that noise signal which would be present at the ear with the cancellation system inactive, as follows:

$$\text{Residual Noise}=(N*AE)-(N*AM*A*DE) \quad (1)$$

where the algebraic operators refer to vector operations, using complex notation and arithmetic to compute amplitude and phase spectra. Clearly, if the microphone and amplifier responses are ideally flat (i.e. both AM and A=1), then the residual noise at the ear after the cancellation process will be minimal if the ambient-to-ear (AE) and driver-to-ear (DE) responses are similar (and it will be zero if they are identical).

Accordingly, for the purposes of ambient feed-forward or feedback (noise-cancellation, it is desirable to devise a system in which the ambient-to-ear (AE) and driver-to-ear (DE) transfer functions are closely matched.

However, mismatches between these two functions are inevitable. Owing to the physical complexity of the various acoustical and electrical transfer functions themselves, and the limitations of the relatively simple signal-processing that is economically achievable in practice (particularly if using analogue circuitry), it is not possible to create perfect noise-cancellation throughout the spectrum. It is unavoidable that time-delay discrepancies and spurious acoustic resonances, coupled with the finite frequency response of the loudspeaker, result in imperfections in matching between the generated cancellation signal and incoming noise signal.

A number of parameters can affect one of the aforementioned pathways relative to the other, but the inventor has discovered, in particular, that one form of mismatch between them, which causes significant localised disturbances within the frequency band over which noise reduction is sought, occurs when there is an acoustical or mechanical resonance in one of the pathways, but not the other. For example, the transfer function DE associated with the pathway for the acoustic cancellation signal includes the mechanical resonance of the loudspeaker as an integral, serial element, but it is only a secondary, parallel element in the transfer function AE associated with the pathway for the ambient acoustic noise signal.

Thus, localised mismatches frequently occur in particular regions of the spectrum. In principle, it would seem that a "band-pass" (or "band-cut") filter might be used to match the amplitude response of the DE function to that of the AE function more closely within a specific, localised region of the spectrum. However, although such arrangements can be devised to provide suitably matched amplitude responses, the inventor has found conventional electronic band-pass filters to be unsuitable for noise-reduction signal processing due to the introduction of gross mismatches in phase.

Moreover, it is desirable that the effect of the localised signal processing does not unduly perturb either the amplitude or phase in the remainder of the spectrum. This desirable effect can not be met either, using conventional band-pass filter arrangements.

An aim of the invention, therefore, is to compensate, at least in part, for such differences in resonant characteristics in order to achieve a degree of amplitude and phase matching between the ambient acoustic noise and acoustic cancellation signals sufficient to provide a useful degree of ambient noise reduction.

According to the invention from one aspect, an ambient noise-reduction system is provided with electrical signal processing means including at least one band-pass and/or band-cut filter having complex impedance characteristics representative of a resonant system. By this means, it can be arranged that the frequency-dependent amplitude and phase characteristics of the at least one filter both behave in concordance with those of the differences between the ambient-to-ear and driver-to-ear functions, because these also derive from resonant acoustical or mechanical phenomena.

According to the invention from another aspect there is provided a noise reduction system having microphonic means disposed at or near the ear of a listener to convert ambient acoustic noise incident thereon into electrical signals, signal processing means including means for inverting the electrical signals, and acoustic generator means utilising the inverted electrical signals to generate further acoustic signals intended for combination at the listener's ear with ambient noise directly received thereat in a sense tending to reduce the ambient noise perceived by the listener, wherein the signal processing means includes at least one filter comprising a resonant electrical circuit configured to impose, upon said electrical signals or said inverted electrical signals, predetermined band-boost or band-cut filter characteristics with concomitant amplitude and phase modifications to compensate at least in part for differences in said acoustic signals attributable to differences associated with the respective pathways by means of which the two acoustic signals reach the ear.

Preferably, said at least one filter comprises in effect an L-C-R resonant circuit; thereby providing a predetermined band-boost or band-cut centred upon a specific frequency, and retaining a pre-determined gain elsewhere in the spectrum.

In such circumstances, it is further preferred that the said resonant circuit conforms effectively to a series L-C-R resonant circuit since, by this means, phase modifications are restricted to that region of the spectrum which is required to be modified.

Preferably the L-C-R resonant circuit is configured either as a band-pass or band-cut filter by connection as a frequency-dependent impedance as part of a potential divider arrangement with a further resistor.

It is further preferred to incorporate the effective L-C-R network into an operational amplifier circuit in order to create both band-pass filters and band-cut filters.

In most preferred embodiments of the invention, the electrical properties of the inductive (L) element of the resonant circuit are emulated by means of an active component such as an operational amplifier or transistor configured into a gyrator circuit.

In some preferred embodiments of the invention, the filter is realised as an analogue filter, thereby to more readily permit the critical timing criteria of noise-reduction systems to be met economically; and further preferably, the analogue filter has an amplitude response that has a peak or trough at a centre frequency, and a phase response that switches polarity at the centre frequency and tends to zero with increase or reduction in frequency away from the centre frequency.

Such preferred embodiments may conveniently find use in a sound reproduction system producing a target filter characteristic required to provide optimal noise cancellation over a pre-determined frequency band, the target filter characteristic including a resonant peak at a first frequency, the noise reduction system comprising:

at least one high pass and/or high cut filter for substantially matching the target filter characteristic over a range of frequencies below or encompassing the first frequency, wherein the centre frequency in the amplitude response is substantially equal to the first frequency.

In further embodiments of the invention, the aforesaid analogue filter preferably comprises elements having an effective capacitance value and an effective inductance value, the effective capacitance value and the effective inductance value together defining a resonant frequency; and further preferably the elements having the effective capacitance value and the effective inductance value are connected in series. Conveniently, the element having the effective inductance value is a gyrator circuit or virtual inductor.

Systems in accordance with various embodiments of the invention may conveniently be incorporated into, or otherwise supported by, various portable or mobile devices and the like, such as: an earphone or a headphone; a cellular telephone; a mobile electronic music reproducing device such as an MP3 player; or a PDA.

Figure 4A:
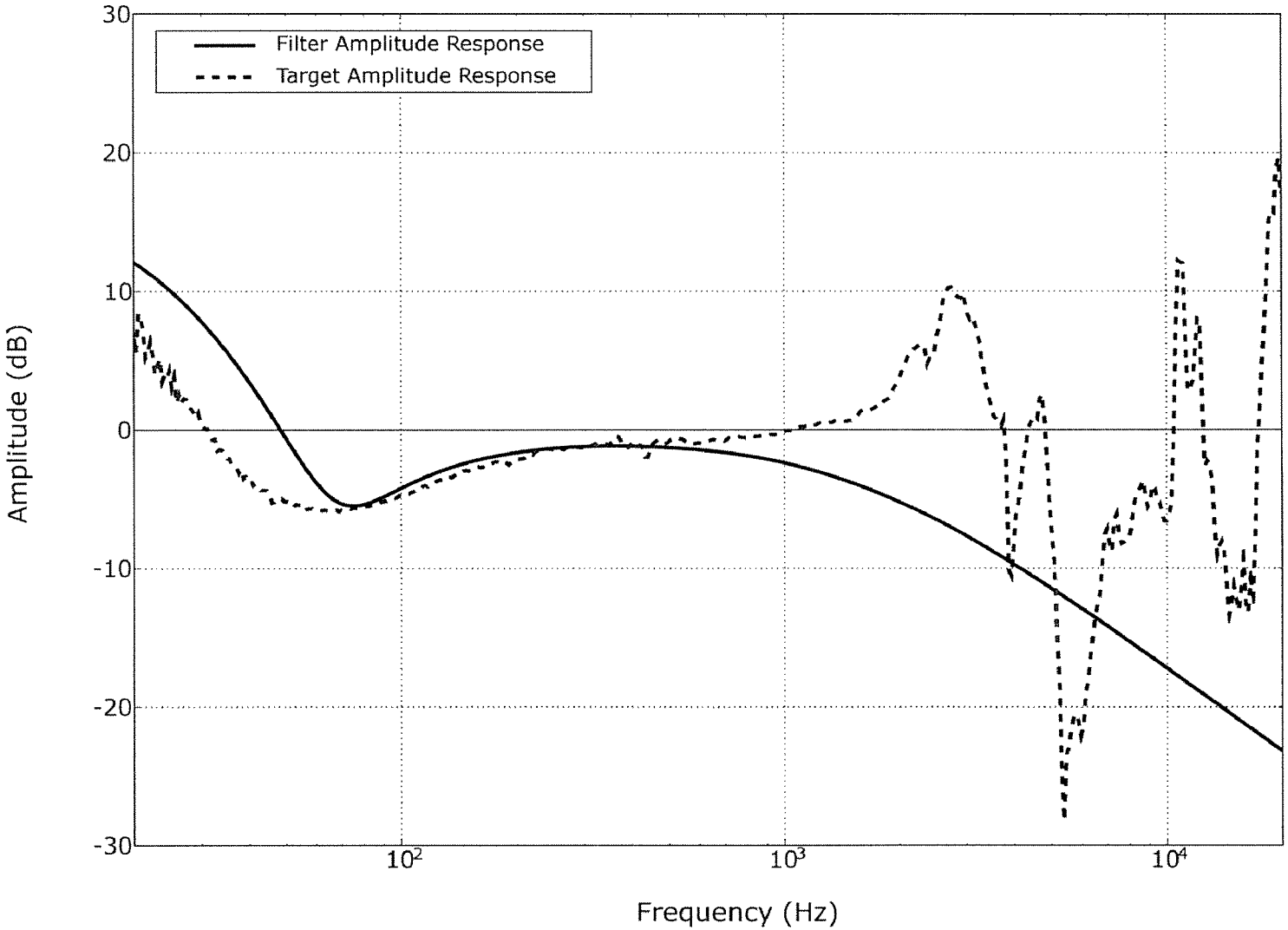
Figure 4B:
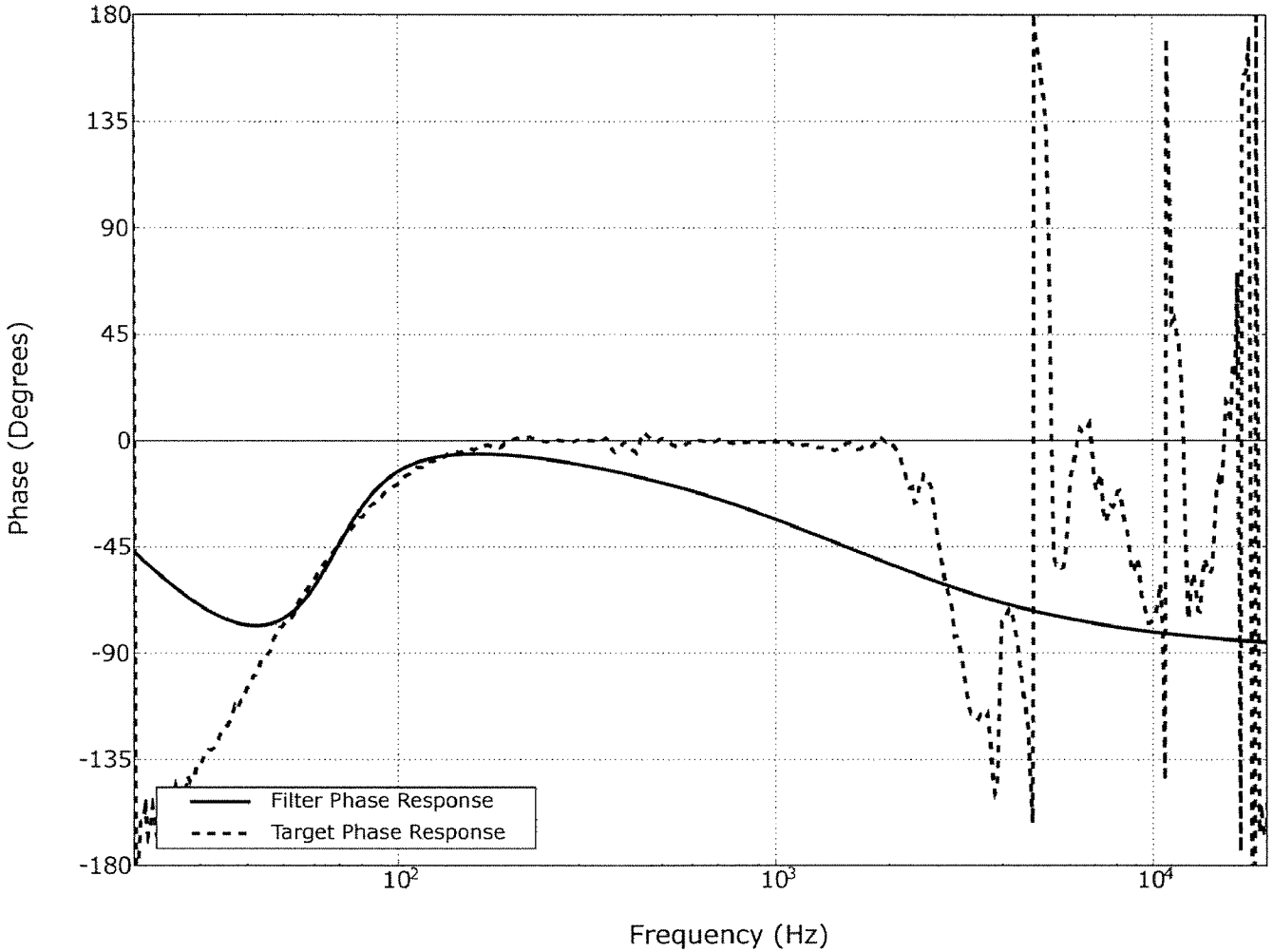
Figure 5A:
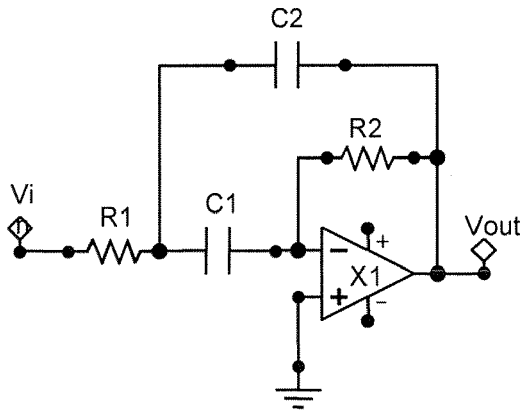
Figure 5B:
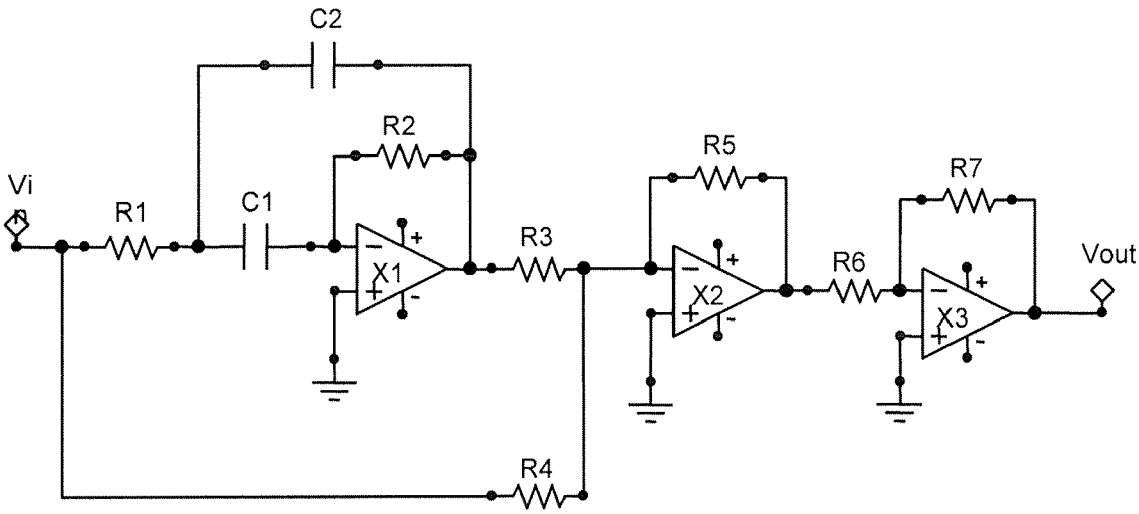
Figure 6:
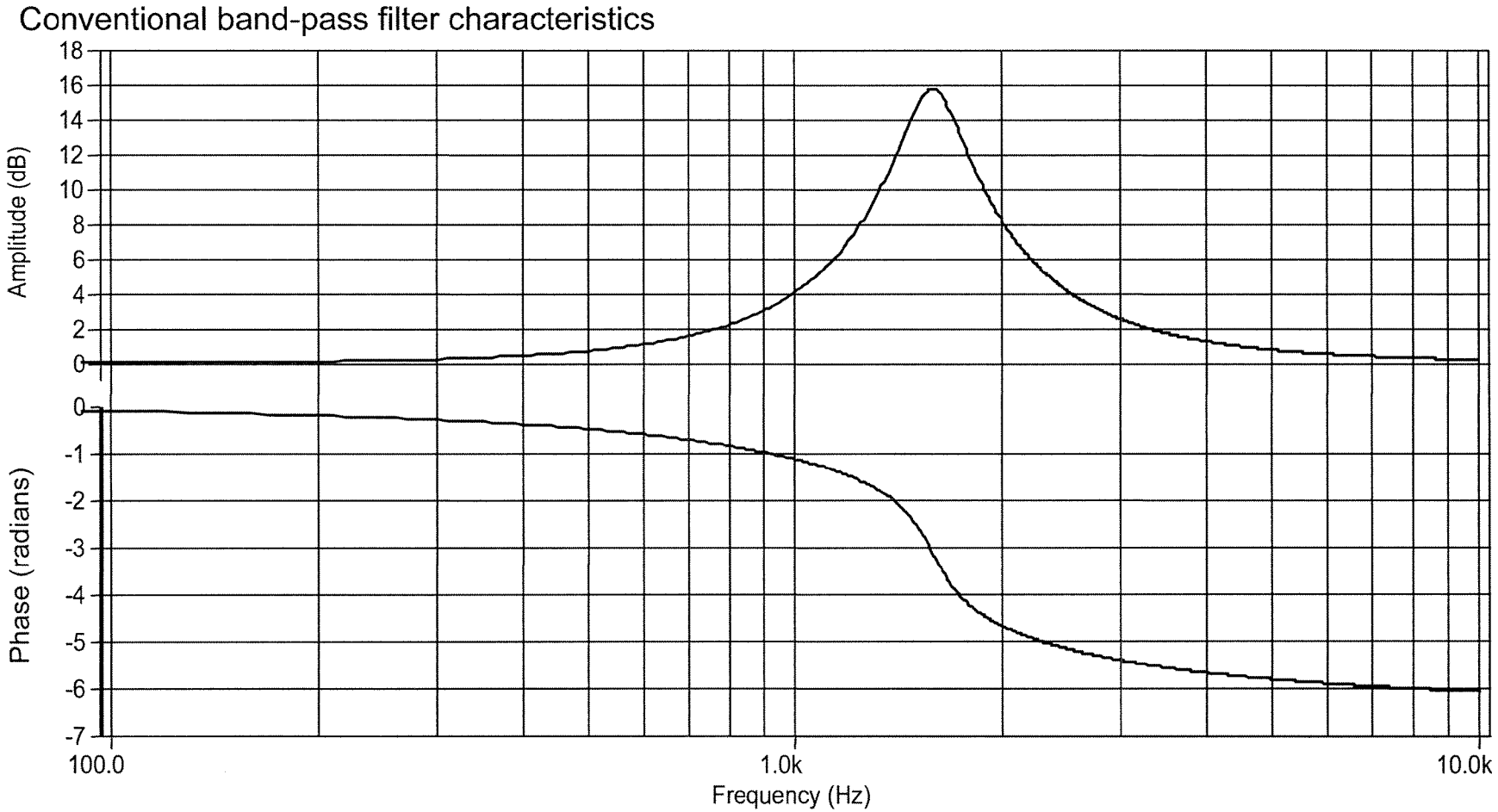

In order that the invention may be clearly understood and readily carried into effect, certain embodiments thereof, together with supportive background information, will now be described with reference to the accompanying drawings, of which:

FIGS. 1, 2 and 3, to which reference has already been made show, respectively, a conventional feed-forward ambient noise-reduction system and diagrams explanatory of transfer functions associated with acoustical and acoustical-electric pathways to the ear;

FIGS. 4*a* and 4*b* show typical amplitude and phase spectra respectively of noise-reduction filters, and indicate best-fit functions;

FIGS. 5*a* and 5*b* show respectively a conventional band-pass active filter circuit and its configuration as a gain-limited band-pass filter;

FIG. 6 shows amplitude and phase plots indicative of the performance of the circuit of FIG. 5*b;*

Figure 7A:
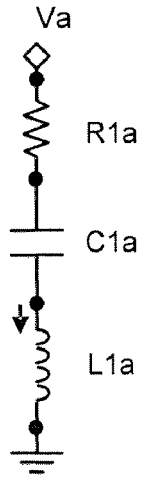
Figure 7B:
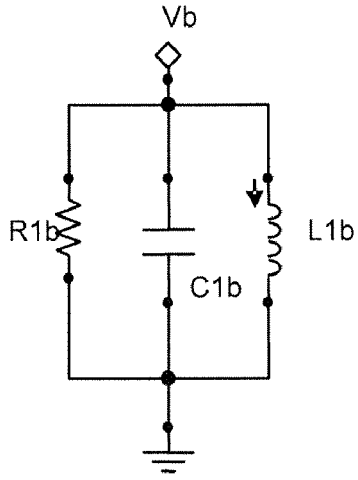
Figure 7C:
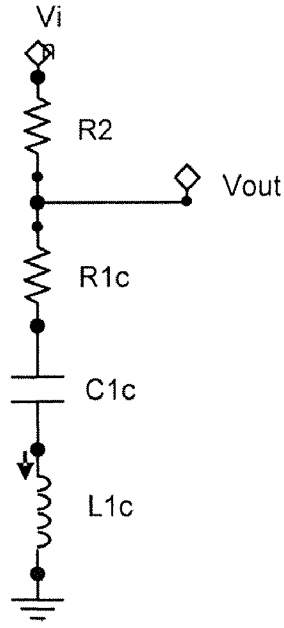
Figure 8A:
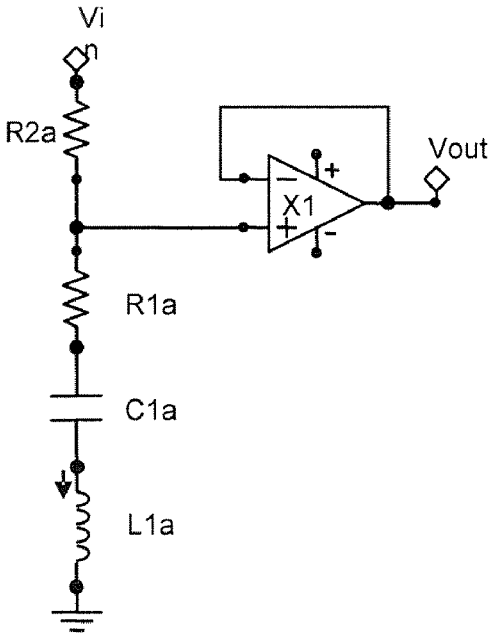
Figure 8B:
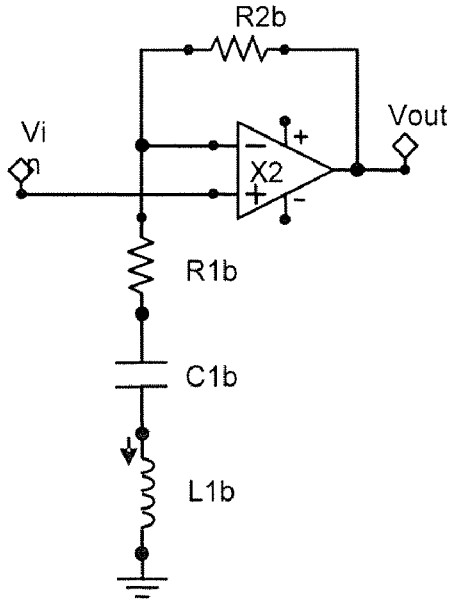
Figure 9A:
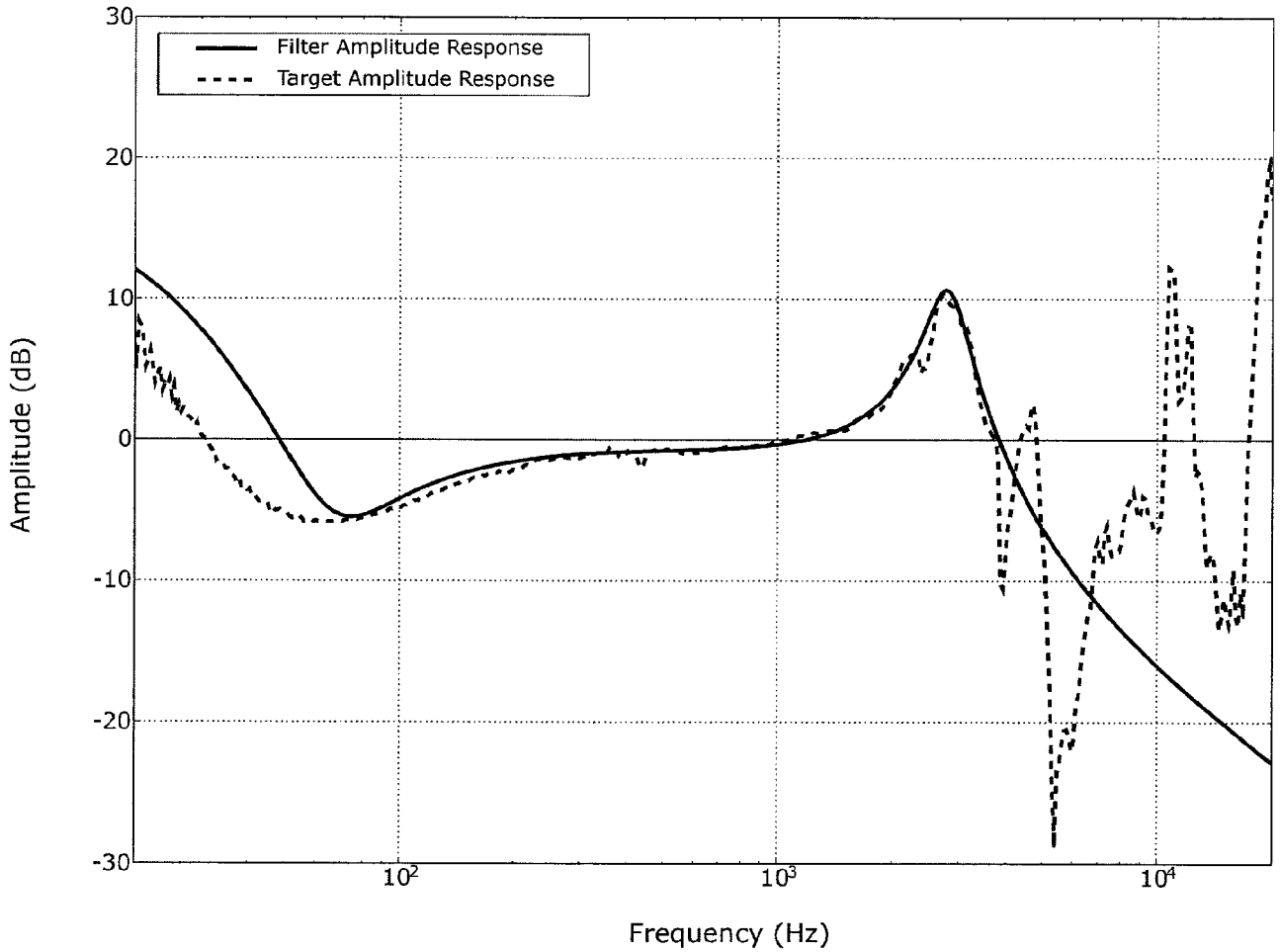
Figure 9B:
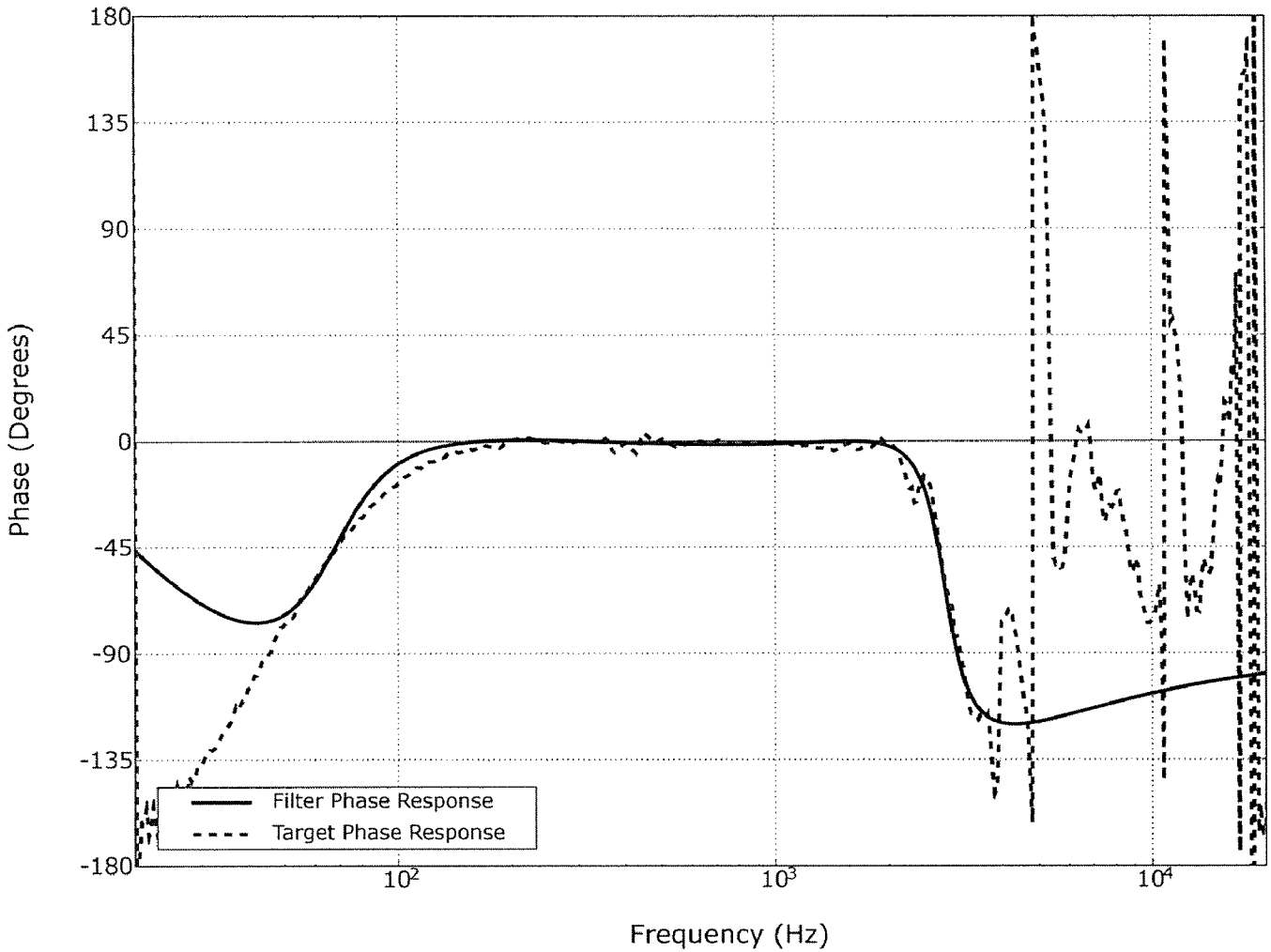
Figure 10A:
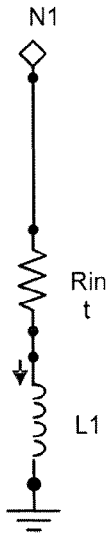
Figure 10B:
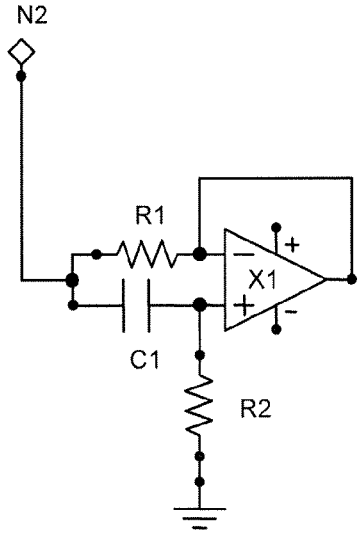
Figure 11A:
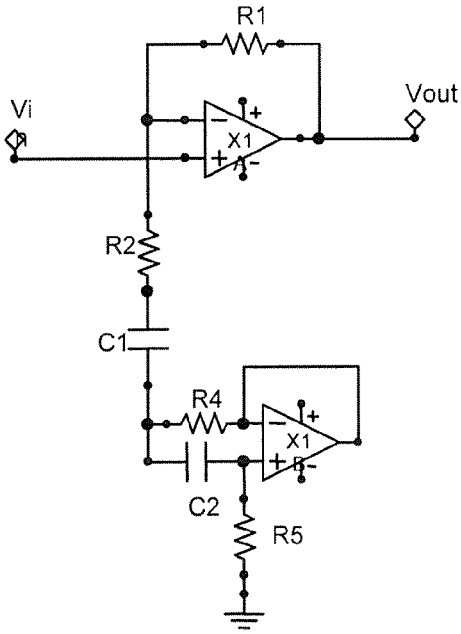
Figure 11B:
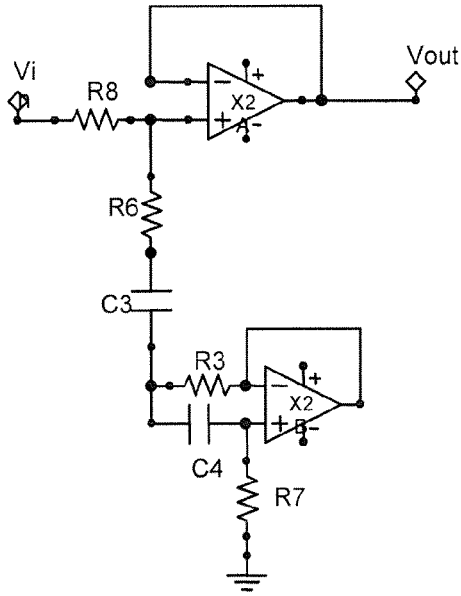
Figure 12:
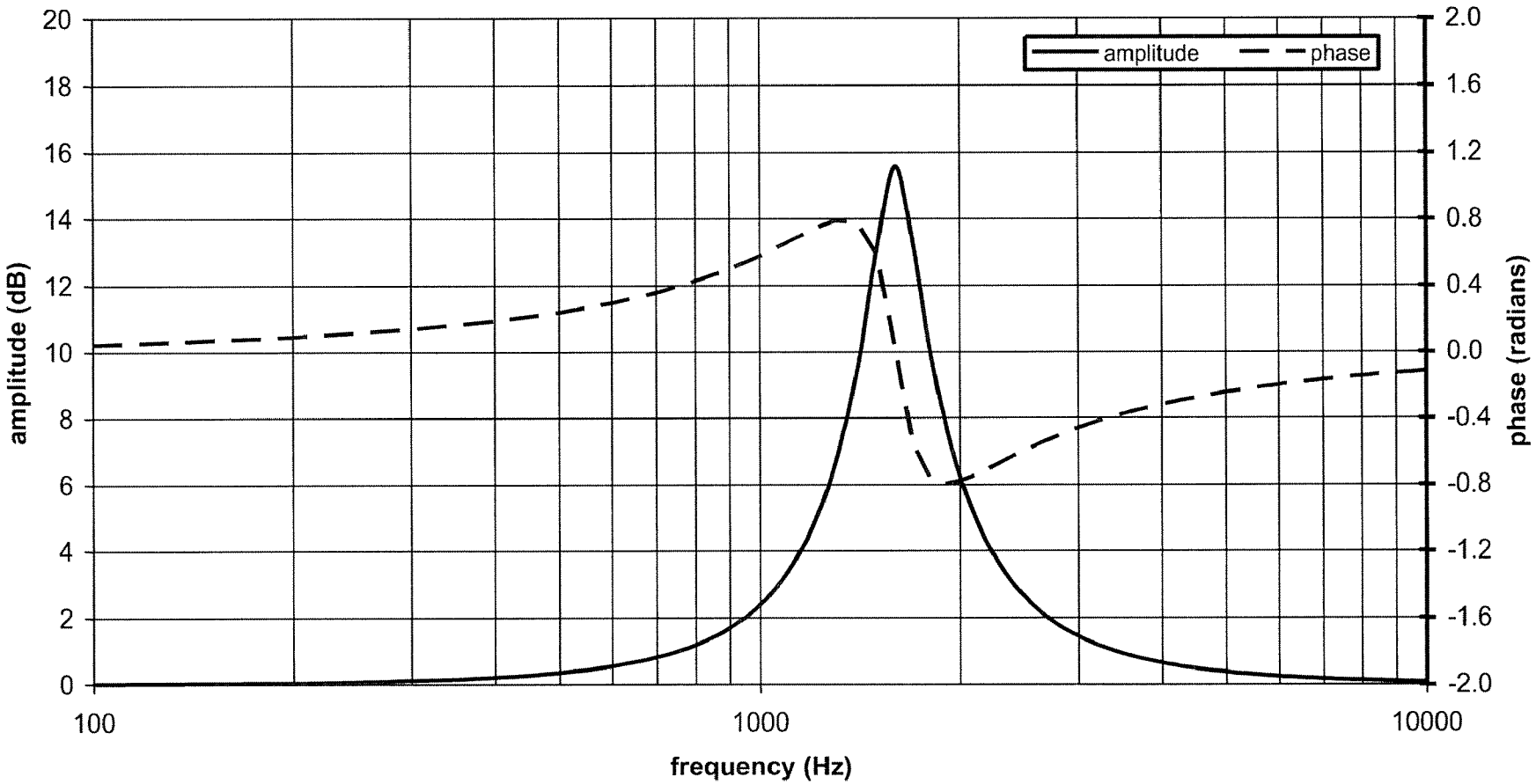
Figure 13:
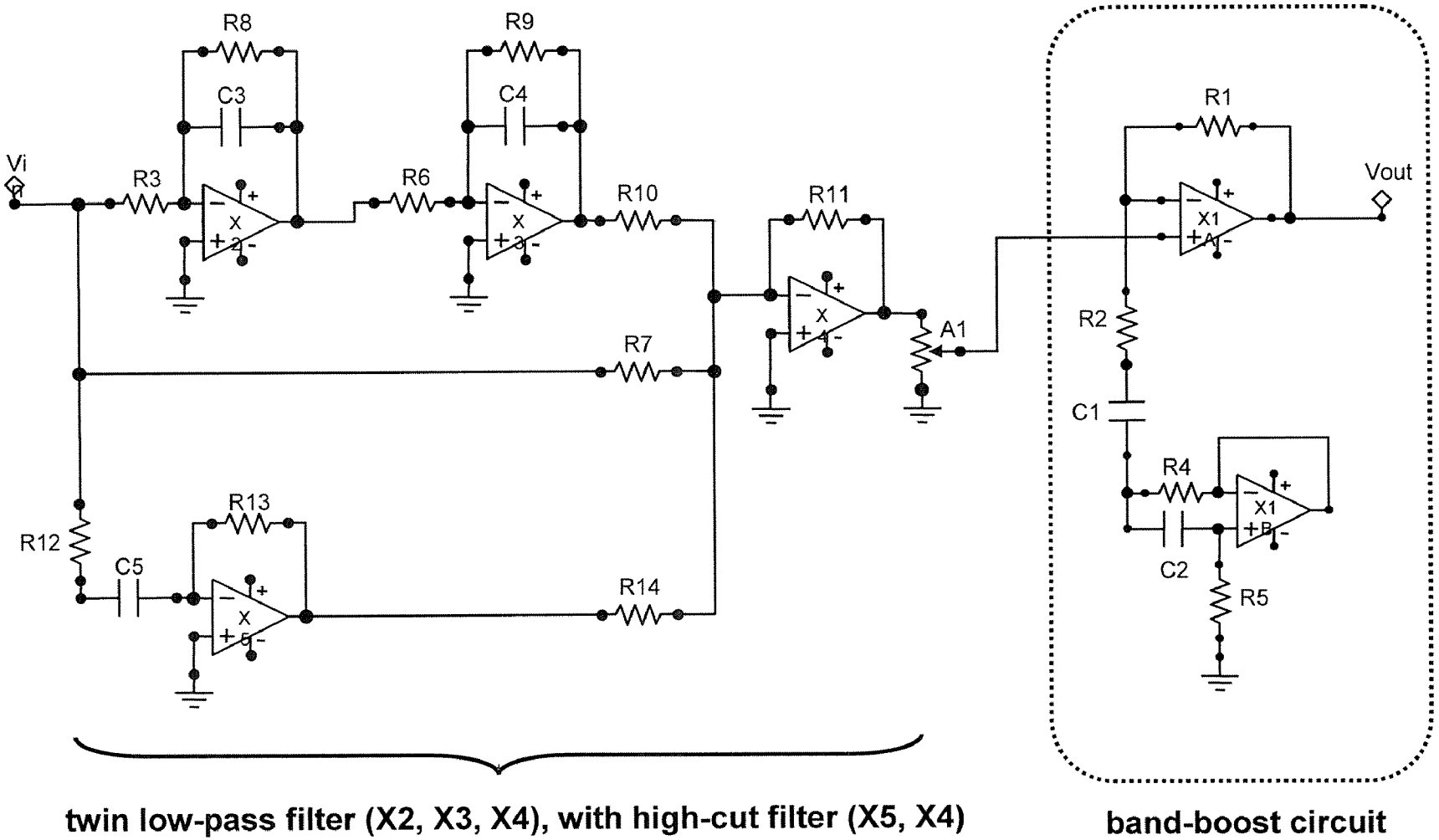

FIGS. 7*a*, 7*b* and 7*c* show parallel and series L-C-R circuit arrangements;

FIGS. 8*a* and 8*b* show active filter circuit arrangements utilising series L-C-R circuits;

FIGS. 9*a* and 9*b* show respectively amplitude and phase spectra of noise-reduction filters utilising an L-C-R resonant circuit;

FIGS. 10*a* and 10*b* show respectively an inductor and its equivalent gyrator circuit;

FIGS. 11*a* and 11*b* show respectively gyrator-based active band-boost and band-cut filters;

FIG. 12 shows amplitude and phase plots showing the characteristics of a gain-limited gyrator-based band-boost filter circuit; and FIG. 13 shows a circuit arrangement of a system designed to provide optimal noise cancellation over a predetermined frequency band.

A practical example of the requirements for spectrally-localised band-pass/band-cut processing is shown in FIG. 4, which shows various transfer functions relating to a feedforward noise-reduction system. FIG. 4*a* shows the amplitude response as a function of frequency, and FIG. 4*b* shows the associated phase response. The dashed lines represent a desired "target" filter characteristic to provide optimal noise-cancellation, and the solid lines represent a filter characteristic typical of the best currently achievable, using filtering based on combinations of high-pass and low-pass networks. At frequencies above approximately 6 kHz, it becomes impractical to match the detail of the target functions, which therefore can be ignored in the present explanations.

Referring to the amplitude plot of FIG. 4*a*, the solid line represents the transfer function of a signal-processing stage, using progressive high-pass and high-cut filter arrangements that have, as far as possible, been optimised to match the target amplitude function (dashed line) and thereby maximise the noise-reduction performance.

By comparison of the signal processing characteristics with those of the target function, it can be seen that there is a good match between the two at lower frequencies, between 80 Hz and 900 Hz for example, but that significant mismatches of more than 10 dB occur in the region above 1 kHz. The nature of the mismatch is such that a localised increase in amplitude, approximately in the form of a +15 dB peak at 2.8 kHz, would tend to correct it. It would be desirable, however, that such a modification be accompanied by the correct changes in the phase characteristics.

Referring now to the phase plot of FIG. 4*b*, it can be observed from the dashed, target phase characteristic that, in qualitative terms, as the frequency increases it is required to introduce a gradually increasing positive modification to the phase of the filter characteristics up to about 2 kHz, such that the resultant phase characteristic is close to the 0° target, and as the frequency increases further and approaches that of the target amplitude peak, at about 2.8 kHz, the phase modification should flip, i.e. invert, to a moderate negative value, and then (ideally) gradually diminish to zero with further increase in frequency. It will be observed that a characteristic typical of the best currently achievable, as shown by the solid line in FIG. 4*b*, does not match the target characteristic well at all, except in the vicinity of 50 to 200 Hz. Moreover, as mentioned above, it becomes impractical to match the detail of the target functions at frequencies above approximately 6 kHz; this being due to the fact that, because the wavelengths associated with these frequencies are so small, spurious resonances can create gross changes in relative phase.

As stated above, it is desirable that the remedial effects of any signal processing used to achieve such localised modifications do not perturb significantly either the amplitude or phase in any part of the remainder of the spectrum; the amplitude and phase effects of the band-limited signal processing should tend to zero at very low frequencies and very high frequencies.

Of course, the somewhat qualitative description above is intended to convey the type of properties that are required for adding to the signal-processing stage. In practice, rigorous mathematical treatment is required for the incorporation of a suitable band-limited signal processing stage into the overall processing scheme, in which the signals are combined as vectors using complex arithmetic.

A standard method of achieving the required peak in the amplitude spectrum is to use a multiple feedback type band-pass filter, as described, for example, in "Active Filter Cookbook" ($2^{nd}$ Ed.); D Lancaster; Newnes (Elsevier Science), Oxford, 2003, and depicted in FIG. 5*a* hereof as a serial element in the signal-processing chain. The centre frequency, $F_C$, of this arrangement is given by:

$$Fc = \frac{1}{2\pi}\sqrt{\frac{1}{R_1 R_2 C_1 C_2}} \tag{1}$$

The Q factor is equal to the ratio $R_2/R_1$.

In practice, for noise-reducing applications, it is required to provide a limited band-boost or band-cut at a specific frequency, and retain a particular pre-determined gain elsewhere in the spectrum, and this can be achieved by summing together the band-pass filter output with that of a fixed gain amplifier, such that the latter determines the gain of the system away from resonance. Such an arrangement is shown in FIG. 5*b*, in which a first amplifier X1 forms the band-pass filter of FIG. 5*a,* amplifier X2 is an inverting, current-summing amplifier, and amplifier X3 is an inverter used to restore the original signal polarity. Amplifier X2 sums together the contributions of the band-pass filter via R3 (70 kΩ) and the original signal source via R4 (10 kΩ), such that the relative gain of the filter contribution is weighted so as to be 1/7 that of the fixed, unity gain level determined by R4 and feedback resistor R5 (10 kΩ). Hence, at frequencies well above and below $F_C$, where the filter-stage output is very small, the overall gain is unity. At the centre frequency, however, the filter-stage contribution is relatively large, and when added to the unity gain signal at the input to X2, provides the requisite, localised band-boost properties, though only in terms of its amplitude response. By suitable choice of component values, the circuit arrangement of FIG. 5*b* can be designed to introduce approximately a 15.8 dB peak into the spectrum at 1.6 kHz. The amplitude and phase responses of such a circuit are shown in FIG. 6 from which it can be seen that, although the amplitude response is correct for the above example, the phase response is grossly incorrect.

What is required for noise-reducing band-boost applications is, as mentioned above, that the phase response should be almost zero at low frequencies, and as the frequency increases, there should be a gradual positive change in the phase as the frequency increases and approaches the centre frequency, $F_C$, (that of the amplitude peak), at which point the phase modification should flip to a similar, moderate negative value, and then the phase modification should gradually diminish to zero once again at higher frequencies.

In contrast to this, inspection of the phase response of the band-pass filter in FIG. 6 shows that, although the phase response is small at low frequencies, the phase response becomes large and negative with increasing frequency, reaching a value of −180° at the centre frequency, beyond which point, with further increase in frequency, the phase modification continues to increase to even greater negative values, and approaches −360° at high frequencies. This gross variation in phase, extending throughout the spectrum, is very different to the observed requirements of: (a) locally correct phase behaviour near the centre frequency; and (b) minimal phase effect over the remainder of the spectrum and thus, if uncompensated, renders useful noise reduction impossible.

The present invention is based on the principle that an electrical resonant circuit can mimic the properties of an acoustic resonant system. The same mathematical principles are shared by fundamental electrical, acoustical and mechanical systems, as described in detail in Acoustics (1993 edition); L L Beranek; American Institute of Physics, New York (1996); ISBN 0-88318-494-X, and consequently it is possible to devise "analogous" circuits. For example, it is known to create analogous electrical circuits that represent and simulate the overall electrical, mechanical and acoustical properties of loudspeakers and their enclosures.

The invention is based on the hitherto unrecognised principle that resonant L-C-R circuits possess amplitude and phase properties that are well-suited for noise-reducing applications. The two basic resonant configurations are the parallel and serial L-C-R networks, as shown in FIG. 7, in which the two reactive components define the resonant frequency, and the resistor influences the Q-factor of the resonant peak or trough. Slight variants on these configurations are possible by repositioning the resistor, but this does not affect the tuning. The serial (and parallel) L-C-R network exhibits a resonant frequency $F_R$ (or centre frequency, $F_C$) defined by the equation:

$$F_c = \frac{1}{2\pi\sqrt{LC}} \tag{2}$$

In addition, from consideration of the complex impedances, various additional useful characteristics of the network can be derived, including the Q-factor, upper and lower −3 dB cut-off frequencies ($F_U$ and $F_L$), bandwidth (BW) and a gain factor (G).

The upper and lower −3 dB cut-off frequencies are those frequencies at which the total reactive impedance is equal to the resistive impedance, and hence the current in the circuit is 1/√2 times its value at resonance (the "half power points"). It can be shown that:

$$F_U = \frac{R + \sqrt{R^2 + \left(\frac{4L}{C}\right)}}{4\pi L} \text{ and:} \tag{3}$$

$$F_L = \frac{R - \sqrt{R^2 + \left(\frac{4L}{C}\right)}}{4\pi L}$$

The bandwidth (BW) represents the difference between these two frequencies, and hence:

$$BW = \frac{1}{L}\sqrt{R^2 + \left(\frac{4L}{C}\right)} \tag{5}$$

The Q-factor is the ratio of the centre frequency (2) to the bandwidth (5), from which it can be shown that:

$$Q = \frac{F_C}{BW} = \frac{L}{R\sqrt{LC}} \tag{6}$$

The impedance of the serial L-C configuration is relatively large at frequencies above and below resonance, but tends to zero at resonance, at which the impedance of the serial L-C-R configuration (FIG. 7*a*) tends to the value of R.

The impedance of the parallel L-C configuration is the converse of this, with the impedance being relatively small at frequencies above and below resonance, but tending towards an infinite value at resonance, at which the impedance of the parallel L-C-R configuration (FIG. 7*b*), again, tends towards the value of R.

In terms of restricting phase modifications to that region of the spectrum which is required to be modified, it is worth noting that only a serial L-C-R network confers this property. This is because, in the regions of the spectrum lying away from resonant frequency, the current flowing in the serial network is very small, and therefore it has little influence on any circuit of which it is a part. By contrast, in a parallel L-C-R network, in those regions of the spectrum that lie above or below the resonant frequency, either the inductor or the capacitor will have a low impedance and so the parallel L-C-R network will draw current and somewhat affect the phase and amplitude of the circuit of which it is part.

Accordingly, a serial L-C-R network is the more useful resonant configuration for noise-reducing applications because its impedance becomes small only at its resonant frequency, and therefore it is effectively inert throughout the rest of the spectrum; thus the following examples and derivations relate to serial L-C-R networks.

An L-C-R network can be configured either as a band-pass or band-cut filter by using it as a frequency-dependent impedance, Z, as part of a potential divider arrangement with a second resistor, $R_2$, as shown in FIG. 7*c* for a serial L-C-R network in which the output voltage, $V_{OUT}$, on the branching node, is defined as a fraction of the input voltage $V_{IN}$ by the usual potentiometric relationship:

$$V_{OUT} = V_{IN}\left(\frac{Z}{Z + R_2}\right) \tag{7}$$

Here it can be seen that, for a serial L-C-R configuration at resonance, where the impedance (Z) is very low, the value $V_{OUT}$ will be reduced to a small fraction of $V_{IN}$, thereby creating a band-cut characteristic. At this point, the impedance of the L-C-R network is effectively equal to the value of its R component, and so the degree of band-cut attenuation can be controlled by the value of R in relation to $R_2$, however this also controls the Q-factor of the network, as quantified below. Away from the resonant frequency, where the value of Z becomes much larger than $R_2$, then the term $Z/(Z+R_2)$ in equation (7) tends to unity, and hence $V_{OUT} \sim V_{IN}$.

In practice, it is convenient to incorporate the serial L-C-R network into an operational amplifier circuit in order to create both band-pass filters and band-cut filters. Examples of this are shown in FIG. 8. The first (FIG. 8*a*) shows the above example in this form, in which a serial L-C-R network is part of a potential divider driven by a second resistor, $R_2$, and now feeding a unity-gain buffer, X1, such that the output voltage $V_{OUT}$ is equal to the voltage on the potentiometlic node between $R_2$ and $R_1$, and thus the circuit exhibits a spectral trough at resonance when the L-C-R impedance tends to a low value, operating as a band-cut filter.

The second example, FIG. 8*b*, shows a serial L-C-R network configured as part of a potentiometric divider, but this time in the feedback circuit of an inverting amplifier, X2. The gain factor, G, of this particular amplifier configuration is given by:

$$G = 1 + \frac{R_2}{Z} = \frac{Z + R_2}{Z} \tag{8}$$

(Where $R_2$ is the feedback resistor of the operational amplifier, and Z is the impedance of the L-C-R network.)

Here, the impedance of the L-C-R network, Z, tends to a small value at resonance, and hence the gain factor attains a maximum value at this point, such that now the resonant amplifier circuit behaves as a band-boost filter.

The amplitude and phase characteristics as functions of frequency can be derived by expanding equation (8):

$$G = \frac{R_1(R_1 + R_2) + \left(\omega L - \frac{1}{\omega C^2}\right)^2 - R_2 j\left(\omega L - \frac{1}{\omega C^2}\right)}{R_1^2 + \left(\omega L - \frac{1}{\omega C^2}\right)^2} \tag{9}$$

From which the frequency-dependent modulus, |G|, can be shown to be:

$$|G| = \frac{1}{(R_1^2 + K^2)}\sqrt{(R_1^2 + R_1R_2 + K^2)^2 + R_2^2K^2} \tag{10}$$

Where:

$$K = \omega L - \left(\frac{1}{\omega C}\right) \tag{11}$$

And the frequency-dependent phase, Φ, is given by the expression:

$$\phi = \tan^{-1}\left\{\frac{-R_2\left(\omega L - \frac{1}{\omega C}\right)}{R_1(R_1 + R_2) + \left(\omega L - \frac{1}{\omega C}\right)^2}\right\} \tag{12}$$

In order to illustrate the value of the above for providing the requisite correct amplitude and phase matching, an L-C-R network according to the present invention was added to the existing, poorly matched filter arrangements shown in FIG. 4, having characteristics that were calculated to provide an optimum correction of the mismatch, namely a centre frequency ($F_C$) of 2.8 kHz, a Q-factor of 4, and a gain factor of 6.5 (16 dB).

The results of the incorporation of the L-C-R network are shown in FIG. 9, which demonstrate a much improved match of both amplitude and phase filter responses to the target values. FIG. 9*a* shows that the amplitudes are now well matched up to about 4.5 kHz. FIG. 9*b* shows that the phase responses are also well matched up to about 4.5 kHz. These filter responses represent significant improvements in matching the target criteria over those of FIG. 4.

Physical implementations of these arrangements have confirmed the accuracy of the above data, and measurements on a headphone noise-reduction system incorporating them also confirm much improved noise-reduction performance using the L-C-R network, with active cancellation operating up to about 4 kHz, rather than 800 Hz.

In principle, the serial L-C-R network is perfectly suited to noise-reduction filter applications, where operation is required typically in the 100 Hz to 5 kHz region. Unfortunately, however, the use of an L-C-R network in this context requires the use of a large inductance value; typically several henries in value. For example, in order to implement a band-boost filter at 1.6 kHz (using equation (1)), even if a relatively large value of C is chosen, say, 0.1 μF, then the required value of L is 0.1 H.

The inventor has further recognised however that this limitation can be overcome by the use of a relatively little-utilised circuit, called a "gyrator" or "virtual inductor" circuit, in which an active component such as an operational amplifier or transistor is configured so as to emulate the electrical properties of an inductor. Such circuits are known, but not in commonplace use, being employed only for a small number of specialised applications.

An inductor inevitably has an intrinsic internal resistance associated with it (FIG. 10*a*), and these properties can be simulated by the gyrator circuit of FIG. 10*b*, in which the simulated inductance has a value, $L_{SIM}$, according to the following equation.

$$L_{SIM} = C_1R_1(R_2 - R_1) \tag{13}$$

In practice, the electrical current limitations of operational amplifiers impose a minimum internal resistance of about 100 Ω for the simulated inductance, but this is well-suited for use with L-C-R circuits where a total value of R might be several kΩ. Indeed, the inventor has observed that incorporating the R element of the serial L-C-R network as part of the gyrator circuit can reduce the overall noise level of the circuit, especially at the centre-frequency, $F_C$.

In addition, the circuit of FIG. 10*b* represents the equivalent of a grounded inductor, that is, having one of its connections always connected to ground (FIG. 10*a*). However, this too, is not at variance with the present invention, because the embodiments of FIGS. 8*a* and 8*b* actually require the use of a grounded inductor. There are alternative circuits which simulate "floating" inductors, rather than grounded inductors, but these are more complex. Also, there are several simple transistor gyrator circuits.

FIGS. 11*a* and 11*b* show embodiments of the invention in use as gyrator-based band-boost and band-cut filters respectively, where they represent direct equivalents of the circuits of FIGS. 8*b* and 8*a* respectively.

Here, the required component values can be computed by working backwards from the required $F_C$ and gain values, and by judicious selection of component values. As a numerical example, consider the design of a gyrator-type band-boost characteristic similar to that of FIG. 6 (which derives from the earlier, conventional circuit of FIG. 5), then the $F_C$ must be 1.6 kHz and the required gain is, say, 6 (15.6 dB). The Q-value is about 7.

EXAMPLE

Gyrator Band-Boost Circuit ($F_C$=1.6 kHz; G=15.6 dB; Q=7)

First, referring to FIG. 8*b* for component numbering, a suitable component value of $C_1$(of the L-C-R element) is chosen, typically as large as is convenient: say 0.1 μF, and then this allows calculation of the simulated inductance using equation (2):

$$L_1 = \frac{1}{4\pi^2 F_C^2 C_1} = 0.099 \text{ H} \tag{14}$$

From this, $R_1$ can be calculated via re-arranged equation (6):

$$R_1 = \frac{1}{Q}\sqrt{\frac{L_1}{C_1}} = 0.142 \text{ k}\Omega \tag{15}$$

Substituting $R_1$ for Z (the resonance impedance) into equation (8) allows calculation of $R_2$ for the gain value of x6 (15.6 dB) at resonance:

$$R_2=(G-1)R_1=0.711 \text{ k}\Omega \tag{16}$$

Next, referring now to FIG. 11*a* for component numbering, the gyrator components can be calculated, firstly by assuming nominal values for $R_4$ and $C_2$, say 100 Ω and 0.1 μF respectively, and then the value of $R_7$ is obtained via equation (13) using the value of $L_1$ from equation (14) above:

$$R_5 = \left(\frac{L_1}{C_2 R_4}\right) + R_4 = 10 \text{ k}\Omega \tag{17}$$

FIG. 12 shows the amplitude and phase characteristics of the gyrator band-boost circuit of FIG. 11*a* using the above, derived values, which comply with the 1.6 kHz target specification stated above. It is evident that these phase characteristics differ considerably from those of the multiple feedback band-pass filter, shown in FIG. 6.

Here, the gyrator band-boost phase response of FIG. 12 matches the requirements for use in noise-reducing circuits stated earlier, in that the phase response should be almost zero at low frequencies, and as the frequency increases, there should be a gradual positive change in the phase as the frequency increases and approaches the centre frequency, $F_C$, (that of the amplitude peak), at which point the phase modification should flip to a similar, moderate negative value, and then the phase modification should gradually diminish to zero once again at higher frequencies.

The gyrator band-cut response has similar, localised phase properties, and having inverted amplitude and phase gradients, and it, too, is also suitable for noise-cancellation applications, where a localised spectral modification is required.

Referring now to FIG. 13, there is shown a sound reproduction system, depicted here for illustrative purposes as two stages configured in series and producing a target filter characteristic. The first stage comprises a second-order low pass filter arrangement, comprising two low-pass filters incorporating amplifiers X2 and X3 respectively and connected in series. in combination with a high-cut filter incorporating amplifier X5. This first stage arrangement, acting alone, represents the closest possible fit to the target characteristics of FIGS. 4*a* and 4*b* in the absence of the present invention.

When the second stage, in this case comprising a band-boost circuit according to an example of the present invention, having suitably chosen parameters, is connected in series after the first stage, as shown in FIG. 13, the resultant filter characteristics are transformed from the solid line data of FIGS. 4*a* and 4*b* into the solid line data of FIGS. 9*a* and 9*b*; the latter being clearly a much closer match to the dashed-line target characteristics.

It is noted that the invention may be used in a number of applications. These include, but are not limited to, portable or mobile applications, medical applications, industrial applications, aviation and automotive applications. For example, typical consumer applications include earphones, headphones, mobile communications, PDAs, personal music players, gaming devices, personal computers and active noise cancellation. Typical medical applications include hearing defenders and hearing aids. Typical industrial applications include active noise cancellation apparatus and systems such as hearing defenders. Typical aviation and automotive applications include active noise cancellation apparatus and systems such as a pilot's headset and/or in-flight audio and/or video entertainment apparatus.

It should be noted that the above-mentioned embodiments illustrate rather than limit the invention, and that those skilled in the art will be able to design many alternative embodiments without departing from the scope of the appended claims or drawings. The word "comprising" does not exclude the presence of elements or steps other than those listed in a claim, "a" or "an" does not exclude a plurality, and a single element or other unit may fulfil the functions of several units recited in the claims. Any reference signs in the claims shall not be construed so as to limit their scope.

The invention claimed is:

1. Signal processing circuitry, for an ambient noise-reduction system for use in a sound reproduction system, producing a target filter characteristic required to provide optimal noise cancellation over a predetermined frequency band, the target filter characteristic including a resonant peak at a first frequency, the signal processing circuitry comprising:

an analogue filter, having an amplitude response that has a peak or trough at a center frequency, and a phase response that switches polarity at the center frequency and tends to zero with increase or reduction in frequency away from the center frequency, wherein the center frequency in the amplitude response is substantially equal to the first frequency.

2. Signal processing circuitry as claimed in claim 1, wherein the analogue filter has a gain that tends to a predetermined value away from the center frequency.

3. Signal processing circuitry as claimed in claim 1, wherein the analogue filter comprises inductive, capacitive and resistive elements.

4. Signal processing circuitry as claimed in claim 3, wherein the inductive, capacitive and resistive elements of the analogue filter are connected in series.

5. Signal processing circuitry as claimed in claim 3, wherein the inductive, capacitive and resistive elements form a frequency dependent impedance connected in a potential divider arrangement with a further resistor.

6. Signal processing circuitry as claimed in claim 3, wherein the analogue filter includes an operational amplifier.

7. Signal processing circuitry as claimed in claim 3, wherein the inductive element comprises an active component.

8. Signal processing circuitry as claimed in claim 7, wherein the active component is configured into a gyrator circuit.

9. Signal processing circuitry as claimed in claim 3, wherein the center frequency is defined by effective inductance and capacitance values of the inductive and capacitive elements respectively.

10. Signal processing circuitry as claimed in claim 1, implemented at least in part as an integrated circuit.

11. An ambient noise reduction system, comprising:

a microphone for converting ambient acoustic noise into electrical signals, signal processing circuitry, for inverting and filtering the electrical signals, and an acoustic generator, for converting the inverted and filtered electrical signals into an acoustic signal, wherein the ambient noise-reduction system produces a target filter characteristic required to provide optimal noise cancellation over a predetermined frequency band, the target filter characteristic including a resonant peak at a first frequency, and wherein the signal processing circuitry comprises an analogue filter, having an amplitude response that has a peak or trough at a center frequency, and a phase response that switches polarity at the center frequency and tends to zero with increase or reduction in frequency away from the center frequency, wherein the center frequency in the amplitude response is substantially equal to the first frequency.

12. An ambient noise reduction system as claimed in claim 11, configured as a feedforward noise reduction system.

13. A sound reproduction system, comprising an ambient noise reduction system, wherein the ambient noise reduction system comprises:

a microphone for converting ambient acoustic noise into electrical signals, signal processing circuitry, for inverting and filtering the electrical signals, and an acoustic generator, for converting the inverted and filtered electrical signals into an acoustic signal, wherein the ambient noise-reduction system produces a target filter characteristic required to provide optimal noise cancellation over a predetermined frequency band, the target filter characteristic including a resonant peak at a first frequency, and wherein the signal processing circuitry comprises an analogue filter, having an amplitude response that has a peak or trough at a center frequency, and a phase response that switches polarity at the center frequency and tends to zero with increase or reduction in frequency away from the center frequency, wherein the center frequency in the amplitude response is substantially equal to the first frequency.

14. A sound reproduction system as claimed in claim 13, comprising a speaker for playing wanted sounds, wherein said speaker is also used as said acoustic generator of the ambient noise reduction system, for converting the inverted and filtered electrical signals into an acoustic signal.

15. An earphone or headphone device incorporating or otherwise supporting an ambient noise reduction system as claimed in claim 11.

16. A cellular telephone incorporating or otherwise supporting an ambient noise reduction system as claimed in claim 11.

17. A personal music player incorporating or otherwise supporting an ambient noise reduction system as claimed in claim 11.

18. A medical device incorporating or otherwise supporting an ambient noise reduction system as claimed in claim 11.

19. An industrial device incorporating or otherwise supporting an ambient noise reduction system as claimed in claim 11.

20. An aviation device incorporating or otherwise supporting an ambient noise reduction system as claimed in claim 11.

21. An automotive device incorporating or otherwise supporting an ambient noise reduction system as claimed in claim 11.

* * * * *